US005205448A

United States Patent [19]

Kester et al.

[11] Patent Number: 5,205,448

[45] Date of Patent: Apr. 27, 1993

[54] MULTIFUNCTIONAL CAMERA BAG WITH WAIST BELT SUPPORT

[75] Inventors: Eugene A. Kester, Santa Cruz; Hans M. Wain, Truckee, both of Calif.

[73] Assignee: Photoflex, Inc., Santa Cruz, Calif.

[21] Appl. No.: 695,577

[22] Filed: May 2, 1991

[51] Int. Cl.[5] ..... A45F 4/00

[52] U.S. Cl. ..... 224/151; 224/240; 224/253; 224/236; 224/242; 224/901; 224/908; 206/316.2

[58] Field of Search ..... 224/224, 228, 235, 236, 224/237, 240, 242, 253, 901, 908, 151; 206/316.2, 373, 374, 581, 235, 570, 571, 572; 190/106, 31, 17; 150/117, 116, 112; 383/37

[56] References Cited

U.S. PATENT DOCUMENTS

| | | | |
|---|---|---|---|
| 1,513,176 | 10/1924 | Lyde | 224/908 |
| 1,589,315 | 6/1926 | Johnston | 224/908 |
| 1,735,183 | 11/1929 | Salerno | 206/581 |
| 2,487,220 | 11/1949 | Callaghan | 150/116 |
| 3,122,225 | 2/1964 | Ward | 383/37 |
| 3,363,814 | 1/1968 | Hall, Jr. et al. | 224/908 |
| 3,762,616 | 10/1973 | Brunstetter | 224/908 |
| 3,910,470 | 10/1975 | Swenson et al. | 224/908 |
| 4,241,833 | 12/1980 | Luebcke | 206/570 |
| 4,303,158 | 12/1981 | Perkins | 206/373 |
| 4,318,502 | 3/1982 | Lowe et al. | 224/211 |
| 4,479,595 | 10/1984 | Opsal | 224/211 |
| 4,515,300 | 5/1985 | Cohen | 224/253 |
| 4,531,041 | 2/1984 | Leiserson | 224/908 |
| 4,545,414 | 10/1985 | Baum | 150/52 J |
| 4,610,286 | 9/1986 | Cyr | 150/52 J |
| 4,620,579 | 11/1986 | Lowe et al. | 224/316.2 |
| 4,733,806 | 3/1988 | Sloop | 224/316.2 |
| 4,805,749 | 2/1989 | Gerch | 150/117 |
| 4,832,193 | 5/1989 | Kime | 206/373 |
| 4,836,428 | 6/1989 | Evans et al. | 224/253 |
| 4,921,151 | 5/1990 | Duvall | 224/32 R |
| 4,957,231 | 9/1990 | Kalisher | 224/901 |
| 5,025,965 | 6/1991 | Smith | 224/151 |
| 5,042,702 | 8/1991 | Douglass | 224/208 |

FOREIGN PATENT DOCUMENTS

| | | | |
|---|---|---|---|
| 2182552 | 5/1987 | United Kingdom | 206/316.2 |
| 8803461 | 5/1988 | World Int. Prop. O. | 224/904 |

OTHER PUBLICATIONS

*Primary Examiner*—Linda J. Sholl
*Attorney, Agent, or Firm*—Michael J. Hughes

[57] ABSTRACT

A camera and photographic equipment transport system (10) is provided, having a camera bag assembly (12) and a removable belt assembly (14) for transporting the camera bag assembly (12) about a user's waist. The camera bag assembly (12) has a main enclosure (16) with a lid flap (42) which opens away from the user for providing unobstructed access to the main enclosure (16). An attachment strap (78) is threaded through a plurality of supporting loops (38, 76) for firmly attaching the camera bag assembly (12) to the belt assembly (14), and Velcro panels (40, 74) are provided for preventing shifting therebetween. A pair of attachment terminating straps (30) further attaches the camera bag assembly (12) to the belt assembly (14). The camera bag assembly (12) is prevented from sagging by a reinforcement plate (36) within a back wall (34) of the camera bag assembly (12). A plurality of dividers (120), (122) are optionally provided for compartmentalizing the main enclosure (14).

10 Claims, 5 Drawing Sheets

MULTIFUNCTIONAL CAMERA BAG WITH WAIST BELT SUPPORT

TECHNICAL FIELD

The present invention relates generally to camera equipment carrying apparatus, and more particularly to an improved bag for carrying cameras and related equipment. The predominant current usage of the multifunctional camera bag with waist belt support of the present invention is as a means for transporting camera equipment comfortably outdoors, over rough or smooth terrain, and while bicycling, skiing, or in similar adverse circumstances.

BACKGROUND ART

Camera carrying cases are a well known accessory used by both amateur and professional photographers. A subclass of such devices is the camera bag, a usually soft sided case with a plurality of pockets for storing various types of photographic equipment. Camera bags have traditionally been provided with a shoulder strap for carrying the bag over the user's shoulder. Camera bags have been constructed from various materials including leather, synthetic leather substitutes, and cloth materials such as rip-stop nylon and canvas duck.

It has long been known that carrying weight on a user's hips is preferable to carrying that same weight from a position higher on the user's anatomy, since placing the weight over the hips removes strain from the back and further lowers the center of gravity and thus decreases the risk of falling. For this reason, some backpack designs have provided a waist belt for transferring weight strain to the hip area. A more recent development has been the "fanny pack", which is a small pouch attached to a waist belt such that articles may be carried therein with the entire weight of the fanny pack and contents riding on the user's hips.

Some efforts at combining the principles of the fanny pack with the requirements of a camera case have been attempted. These have, heretofore, consisted of modifications of a conventional camera bag to allow it to be carried on a waist belt. However, since conventional camera bags were never intended for this purpose, it is not surprising that such efforts have been less than totally successful.

It is reasonable to assume that a waist-attached camera bag would be found most desirable by those users who carry their camera equipment over considerable distances, such as nature photographers, news photographers and the like. Such persons frequently find themselves in situations where it is most undesirable to have to set their bag down in order to gain access thereto, such as in rough or muddy terrain or in crowds of people. further, in such situations, since there is frequently no work surface on which to place items such as lens caps and the like while working with the camera, it is necessary to keep the bag at hand in order to place such items therein. An important additional factor is that opportunities for obtaining specific photographs are often fleeting. Time taken to remove the bag to gain access therefore time taken trying to gain access to a camera from a conventional bag/belt combination, often means the loss of an opportunity.

One problem which has existed in prior attempts at waist-attached camera bags is that conventional camera bags are designed to be accessed from their "front", which is the accepted terminology for the side of the bag which normally faces away from the user while the bag is being carried. With conventional designs, if the user attempts to gain access to the bag while the is wearing it on a waist belt, the top flap of the bag is interposed between the user and the bag's contents.

Yet another problem which has existed in prior attempts at waist-attached camera bags is that conventional camera bags do not provide a means or centering the weight of the bag over the belt area. The belt may be attached near the top of the bag, but this leaves the bulk of the bag hanging below the weight attachment point over the user's hips. The dangling bag interferes with the movements of the user, and further causes the bag to be jostled abut unduly, thus potentially causing damage to the delicate camera equipment therein. Alternatively, the belt can be attached to the bag near the vertical center of the bag to place the bag more advantageously. However, this solution results, with a conventional camera bag, in the bag sagging and deforming under the weight of its contents.

An example of a camera bag with waist attachment means is found in U.S. Pat. No. 4,545,414 issued to Baum. The camera bag of the Baum invention is intended primarily for use with a shoulder strap only. A belt, for attachment to the waist of a user, is concealed within a pocket in the camera bag during normal use. When required, the belt may be extracted from the pocket and used. The Baum invention is very useful in that it provides a supplemental means of carrying the camera bag for those users who intend to carry the bag with a shoulder strap most of the time. However, since the Baum apparatus is not intended primarily for attachment to the user's waist, the device suffers, as would be expected, from the several aforementioned problems associated with the use of conventional camera bags in this manner.

Yet another example in the prior art of a camera bag capable of waist attachment is sold by Tamrac, Inc., of Canoga Park, CA. The Tamrac~ Convertible~ series of bags are a series of conventional type camera bags with provision for attachment of a belt thereto. One of the series, the Deluxe Convertible~, improves on the Baum patented device in the respect that the belt provided is wider at that portion where the belt is attached to the bag and further is attached closer to the center line of the bag. Of course, this improvement itself leads to the aforementioned problem regarding sagging of the camera bag under the weight of its contents. This problem might be corrected in part by securing the camera bag belt very tightly about the user's waist, but that solution also would detract from the comfort and utility of the device. Furthermore, since the Tamrac- bags are conventional in design except for the addition of a belt, the other aforementioned problems have not been addressed in that design.

All of the prior art camera bags within the inventors' knowledge have been constructed such that the user must either remove the bag to gain access to the contents thereof, or else must work around the top closure of the bag while attempting to gain such access.

No prior art camera bag to the inventors' knowledge has successfully allowed the bag to be comfortably carried on the user's hip area without interfering with the user's movements and while preventing undue airing of the camera equipment therein. All successful applications to date have been attempts to adapt a waist belt to a conventional camera bag.

DISCLOSURE OF INVENTION

Accordingly, it is an object of the present invention to provide a camera bag which can be worn comfortably over long distances.

It is another object of the present invention to provide a camera bag which can contain a considerable weight therein without sagging or deforming.

It is still another object of the present invention to provide a means for carrying camera equipment which is versatile in that it may be carried in a manner most convenient to the moment.

It is yet another object of the present invention to provide a camera bag which can be quickly and easily accessed by the user while it is being carried or worn.

It is still another object of the present invention to provide a means for carrying camera equipment which also provides a working area that is convenient to the user.

It is yet another object of the present invention to provide a means for carrying camera equipment which does not unduly interfere with the movements of the user.

It is still another object of the present invention to provide a means for carrying camera equipment which protects the contents under adverse conditions.

It is yet another object of the present invention to provide a means for comfortably carrying heavy equipment while keeping that equipment accessible to the user.

It is still another object of the present invention to provide a means for carrying camera equipment which conveniently separates the equipment to enhance access thereto.

Briefly, the preferred embodiment of the present invention is a multifunctional camera bag with waist belt support having a generally rectangular fabric primary enclosure for containing a camera and related equipment therein. The primary enclosure is formed with three flexible side walls, and one semi-rigid side wall. A rigid rectangular floor panel is provided, as is a flexible rectangular top. The rectangular top is zippered to open on three sides and is connected so as to hinge on the fourth side. The fourth hinged side of the top is opposed to the semi-rigid side wall of the enclosure, and the camera bag is intended to be worn or carried with the semi-rigid side next to the user and the top hinged side away from the user, such that the top hinges away from the user to enhance ease of access to the bag while it is being worn.

The presently preferred embodiment of the inventive camera bag has a variety of pockets distributed about the exterior of the primary enclosure, one of which has the characteristic that it opens completely around its top and both sides and is hinged at the bottom such that an opening flap folds outward to provide a temporary work surface. A pair of retainer straps holds the work surface in a roughly horizontal position while the bag is being worn by the user.

A waist belt is provided for carrying the inventive camera bag around the hip area of the user. The waist belt is removably attached to the camera bag at the semi-rigid side using an unique combination of Velcro brand fastener and strap fasteners. More specifically, a large VELCRO brand fastener pad is provided to position and hold the waist belt against the camera bag, and a fastening strap is threaded through an alternating series of loops on the belt and on the bag, such that the belt is removably "sewn" to the bag near the top juncture of the combination.

The waist belt is padded in the area of its weight bearing portion. The shape of the waist belt, in combination with the unique semi-rigid bag side and the unique combination of fasteners used for attaching the waist belt to the camera bag prevent the bag from sagging away from the user and further enhance the convenience of the bag and the comfort afforded the user while the bag is being worn or carried. The waist belt of the presently preferred embodiment of the invention has thereon two additional external pocket enclosures with elastic film canister holding loops therein.

Movable semi-rigid dividers for supporting cameras, lenses, and the like are optionally provided. The presently preferred embodiment of the inventive camera bag is further provided with a pair of strap loops for the attachment of a shoulder carrying strap thereto, which shoulder carrying strap may be used instead of, or in conjunction with, the waist belt for carrying the inventive camera bag.

An advantage of the present invention is that the interior of the camera bag can be easily accessed while the bag is being worn, without interference from the top.

Yet another advantage of the present invention is that a convenient work surface is provided for situations in which no other such surface is available.

Still another advantage of the present invention is that the camera bag may be worn or carried, as required.

Yet another advantage of the present invention is that the camera bag will not sag or deform unduly when fully loaded.

Still another advantage of the present invention is that the camera bag can be carried low on the user's hip for comfort.

Yet another advantage of the present invention is that the camera bag will not interfere with the movements of the user or cause undue discomfort.

A further advantage of the present invention is that camera equipment can be easily accessed by the user.

Still another advantage of the present invention is that a substantial weight can be carried therein without undue strain on the user.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE FOR CARRYING OUT INVENTION

The best presently known mode for carrying out the invention is a camera transport system having a camera bag and belt combination with a main compartment closure which opens out of the way of the user when the bag is opened while it is also being worn. The bag and the belt work together to form a system which holds the bag properly for maximum comfort and convenience of the user, and the unique features of the bag provide an improvement over similar prior art bags even when the bag is used without the belt, as when the bag is carried by means of a conventional shoulder strap. The predominant expected usage of the inventive multifunctional camera bag with belt support is in the photographic industry, particularly in the field of nature and news photography, and the like, wherein a means for carrying camera equipment comfortably and safely over considerable distances of irregular terrain is most desirable.

Figure 1:
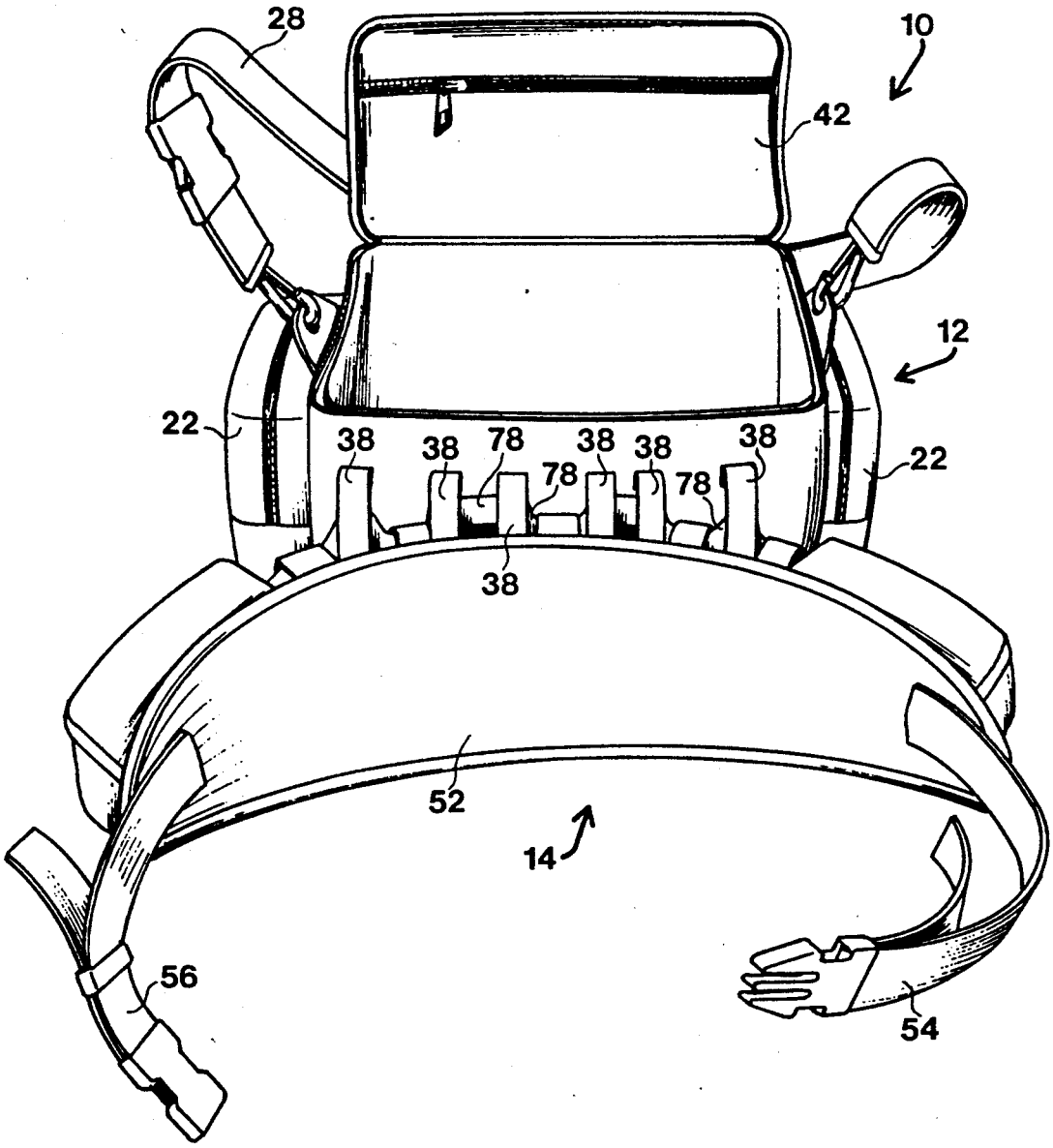
FIG. 1 is a rear perspective view of a camera transport system, according to the present invention.

The camera transport system of the presently preferred embodiment of the present invention is illustrated in a "rear" perspective view in FIG. 1 and is designated therein by the general reference character 10. The primary components of the camera transport system 10 are a camera bag assembly 12 and a belt assembly 14.

Figure 2:
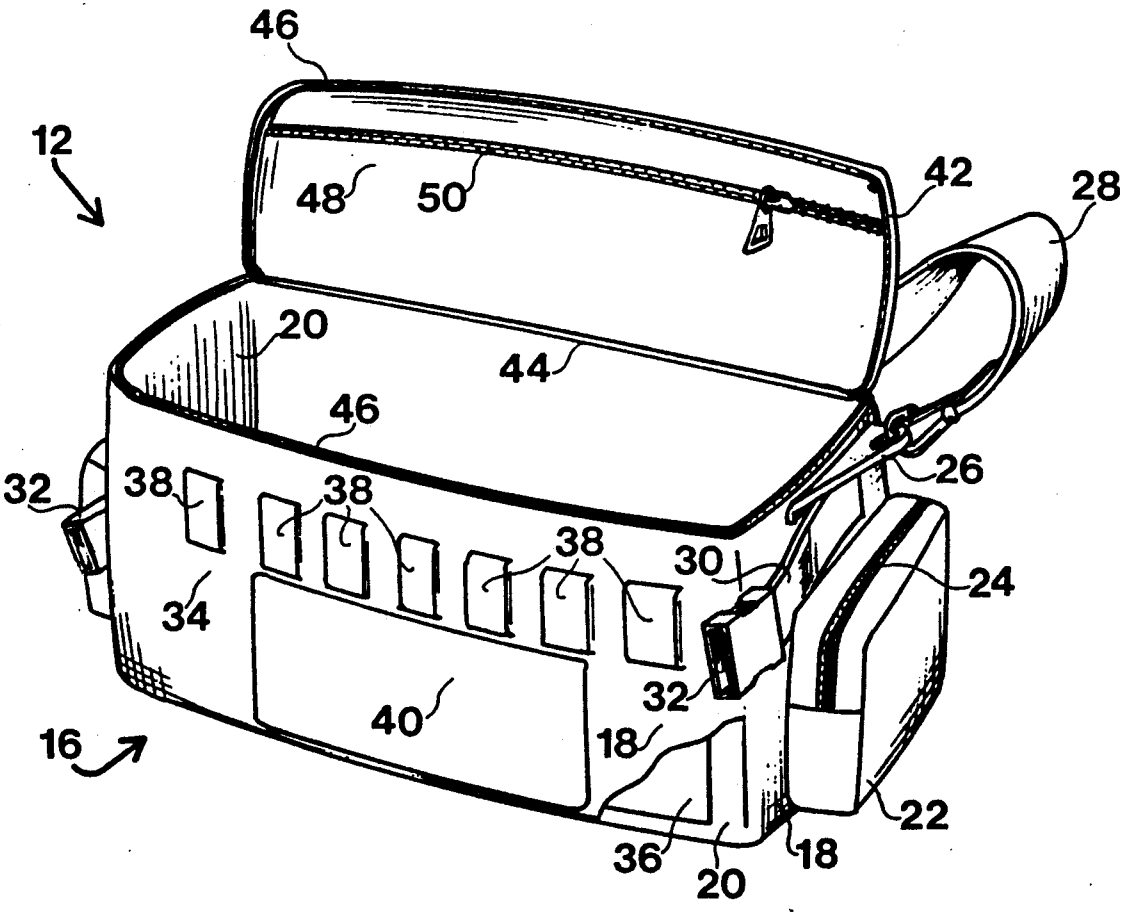
FIG. 2 is a rear perspective view of the camera bag assembly of the present invention, shown with the belt assembly removed therefrom.

A view of the camera bag assembly 12, unobstructed by the belt assembly 14, is provided in FIG. 2. In many of its substantial components, the camera bag assembly 12 does not differ significantly from conventional camera bags. The physical structure is similar, in many respects, to that of prior art camera bas. Conventional elements of the camera bag assembly 12 include a main enclosure 16 having the general form of a hollow rectangular solid. In the best presently known embodiment 10 of the invention the main enclosure 16 is constructed with a shell 18 made from a heavy canvas like material and a lining 20 made form a soft napped cloth. Components of the main enclosure 16, as well as those of additional parts of the camera transport system 10 yet to be described herein, are joined by sewing. Sewn junctions of various component parts are, as is customary in the construction of such items, welted to strengthen the joints and also to enhance the appearance of the article where appropriate. The material from which the main enclosure 16 is constructed is sufficiently rigid such that the camera bag assembly 12 will retain its generally rectangular shape under the force of gravity alone, but it is sufficiently flexible that it will distort if only slight additional force is applied.

Two exterior end pockets 22 (one on either end of the main enclosure 16) are provided on the best presently known embodiment 10 of the invention, one of which is visible in the view of FIG. 2. Access to each of the exterior end pockets 22 is provided by means of a pocket zipper 24. The exterior end pockets are constructed from the same material as is the outer shell 18 of the main enclosure 16. Two shoulder strap attachment rings 26 are provided (one on either end of the main enclosure 16), one of which is visible in the view of FIG. 2. The shoulder strap attachment rings 26 are provided for the attachment thereto of a conventional, removable shoulder strap 28. As is customary, the shoulder strap 28 is adjustable as to length. Below each of the shoulder strap attachment rings 26 is sewn an attachment terminating strap 30 having at the distal end thereof an attachment strap buckle receiver 32. The attachment terminating strap 30 and the attachment strap buckle receiver 32 will be discussed in more detail hereinafter.

Now beginning a discussion of a unique back wall 34 of the present invention, in the best presently known embodiment 10 of the invention a semi rigid reinforcement plate 36 is sewn between the outer shell is and the lining 20 within the back wall 34. The reinforcement plate 36 is sufficiently rigid that considerable force (such as the weight which might be expected when the camera bag 10 is fully loaded) will distort the shape of the reinforcement plate 36 only slightly when the camera bag 10 is supported as will be described hereinafter. It should be noted that the back wall 34 is, in accordance with the customary nomenclature used to describe camera bags, that portion of the main enclosure 16 which is intended to be normally carried closest to a user of the camera bag 10. As used herein, the term "inside" is synonymous with the term "rear", both of which are intended to designate that side of the camera bag assembly 10 visible, for example, in the view of FIG. 2, while the "front" of the camera bag assembly 10 is that side visible in the view of FIG. 4. As can be seen in the view of FIG. 2, the reinforcement plate 36 is not as long as is the back wall 34. This is to provide some flexibility of the back wall 34 near its ends to allow the assembled camera transport system 10 (FIG. 1) to conform to the body shape of the user.

A plurality (in the example of the best presently known embodiment of the invention, seven) of bag supporting loops 38 are attached to the back wall 34, as is shown in the drawing of FIG. 1. The bag supporting loops 38 are much like the belt loops of a garment and are arranged in a like manner. Below the bag supporting loops 38 is attached a rectangular Velcro brand fastener loop 40. Functional aspects of the reinforcement plate 36, the bag supporting loops 38 and the loop panel 40 will be discussed hereinafter.

A lid flap 42 is attached to the main enclosure 16 along a hinge line 44. The hinge line 44 is merely a sewn junction between the lid flap 42 and the main enclosure 16 along which, due to the flexible nature of the lid flap 42 and the main enclosure 16, the lid flap 42 is free to "hinge" open and closed. It should be noted that the lid flap 42 differs significantly from the prior art in that the hinge line 44 is opposed across the main enclosure 16 from the back wall 34, as compared to being attached thereto.

When closed, the lid flap 42 is secured by means of a lid flap zipper 46. The lid flap zipper 46 could have substituted therefore a Velcro brand fastener type closure other similar device, as might any of the closures used in conjunction with the best presently known embodiment 10 of the present invention. Also visible in the view of FIG. 1 is an inside lid pocket 48 having an inside lid pocket zipper 50 for the closing thereof. In the best presently known embodiment 10 of the invention, the inside lid pocket 48 is made of a plastic mesh material in order that the contents thereof can be seen even when the inside lid pocket 48 is closed.

Figure 3:
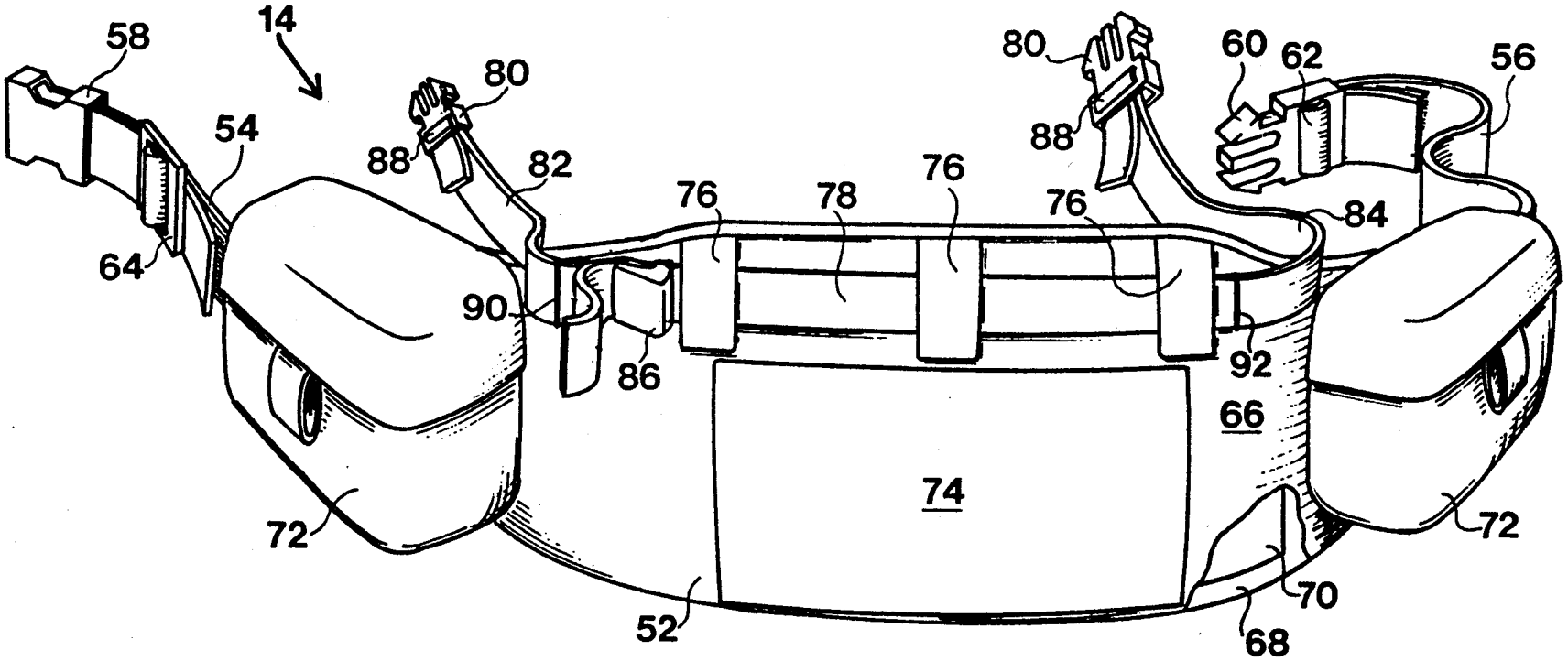
FIG. 3 is a front view of the belt assembly of the present invention, shown detached from the bag assembly.

FIG. 3 is a front perspective view of the belt assembly 14 of the best presently known embodiment 10 of the invention, as viewed from that side not visible in the view of FIG. 1. The belt assembly 14 has a belt center portion 52 having attached thereto a left belt end 54 and a right belt end 56. The belt ends 54 and 56 are made from a webbed belt material. The left belt end 54 has, near its distal end, a primary belt buckle receiver 58, and the right belt end 56 has near its distal end a primary belt buckle hook 60. The primary belt buckle hook 60 and the primary belt buckle receiver 58 are a conventional means for securing belts, straps, and the like. The overall length of the belt assembly 14 is adjustable, in a conventional manner, by pulling the right belt end 56 through a length adjusting loop 62 in the primary belt buckle hook 60. Alternatively, the length of the belt assembly 14 may be altered by means of a conventional slip adjustment ring set 64.

The belt center portion 52 is constructed of an outer layer 66 and an inner layer 68 (visible through a cut away portion of the outer layer 66 in the view of FIG. 3) with a foam pad 70 sandwiched therebetween. In the best presently known embodiment 10 of the invention, the outer layer 66 and the inner layer 68 are constructed of heavy duty nylon cloth, while the foam pad 70 is of a high density foam padding material. The foam pad 70 is provided to cushion that portion of the camera transport system 10 which places the greatest amount of weight against a user's hip area. Furthermore, the foam pad 70 provides some additional rigidity to the portion of the camera transport system 10 wherein it is located. It should be noted that the belt center portion 52 is shaped so as to taper at its ends toward the belt ends 54 and 56 such that the belt assembly 14 is anatomically proportioned to rest on a user's hip area while not interfering with leg movement.

The belt assembly 14 of the best presently known embodiment 10 of the present invention is provided with two belt pouches 72 spaced such that the camera bag assembly 12 (FIG. 2) will fit therebetween. The belt pouches 72 are conventional type pockets constructed from the same material as is the outer shell 18 of the main enclosure 16 (FIG. 2).

A Velcro brand fastener hook panel 74 is attached near the front bottom center of the belt center portion 52. The Velcro brand fastener hook panel 74 is of like size and shape as compared to the Velcro brand fastener loop panel 40 (FIG. 2) of the camera bag assembly 12, and is intended for mating thereto when the belt assembly 14 is attached to the camera bag assembly 12. A plurality (in the example of the best presently known embodiment 10 of the present invention, three) of belt supporting loops 76 are attached, as shown in the drawing of FIG. 3, to the belt center portion 52 above the Velcro brand fastener hook panel 74, and an attachment strap 78 is passed therethrough. The belt supporting loops 76, like the bag supporting loops 38 discussed heretofore in relation to FIG. 2, are similar to the belt loops of a garment. The attachment strap is terminated at both ends by a pair of attachment strap buckle hooks 80 for mating to the attachment strap buckle receivers 32 (FIG. 2) on the camera bag assembly 12. The attachment strap buckle hooks 80 are similar to but smaller than the primary belt buckle hook 60, and the attachment strap buckle receivers 32 (FIG. 2) are similar to but smaller than the primary belt buckle receiver 58. As has been discussed heretofore in relation to the primary belt buckle hook 60, length of the left attachment strap half 52 and the right attachment strap half 84 is adjustable by the passing of the attachment strap halves 82 and 84 through a corresponding attachment strap adjustment loop 88 on their respective attachment strap buckle hooks 80.

The attachment strap 78 has a left attachment strap half 82 and a right attachment strap half 84 such that the attachment strap 78 can be separated at an attachment strap joining buckle 86. The attachment strap joining buckle 86 is a conventional buckle provided so that the attachment strap halves 82 and 84 can be separated so that the attachment strap 78 can be threaded through the belt supporting loops 76 and the bag supporting loops 38 (FIG. 2) and rejoined to secure the camera bag assembly 12 to the belt assembly 14, as will be discussed hereinafter in relation to the industrial applicability of the present invention. The left attachment strap half 82 is sewn to the belt center portion 52 at a left strap attachment point 90, and the right attachment strap half 84 is sewn to the belt center portion 52 at a right strap attachment point 92.

Now beginning a discussion of the method of attachment of the camera bag assembly 12 to the belt assembly 14, there are three different sets of attachment means. Firstly, in the view of FIG. 1, it can be seen that the attachment strap 78 has been threaded through both the bag supporting loops 38 and the belt supporting loops 76, and the attachment strap joining buckle 86 (FIG. 3) has been refastened so as to join the left attachment strap half 82 (FIG. 3) to the right attachment strap half 84 (FIG. 3). In order that this can be illustrated in the view of FIG. 1, this is shown with the right attachment strap half 84 (FIG. 3) not pulled tightly through the attachment strap joining buckle 86 (FIG. 3) such that the camera bag assembly 12 is not pulled tightly against the belt assembly 14. Of course, in actual practice, the user would tighten the attachment strap 78 to pull the camera bag assembly 12 snugly against the belt assembly. This action would cause the second method of attachment to be realized. That is, the Velcro brand fastener loop panel 40 of the camera bag assembly 12 mates with the Velcro brand fastener hook panel 74 of the belt assembly 14. The joining of these rather large Velcro brand fastener panels 40 and 74 is an important aspect of the assembly of the camera transport system 10, as shifting of the camera bag assembly 12 in relation to the belt assembly 14 is prevented thereby.

After the above discussed joining procedures have been accomplished, as a final means of securing the camera bag assembly 12 to the belt assembly 14 the user joins each of the attachment strap buckle hooks 30 (FIG. 3) to its respective attachment buckle receiver 32. The combination of support means and methods described herein provides a secure bond between the camera bag assembly 12 and the removable belt assembly 14 such that there is no uncomfortable, awkward or dangerous shifting therebetween when the camera transport system 10 is in use, and further such that there is no danger of the camera bag assembly 12 inadvertently becoming disattached from the belt assembly 14. Nevertheless, these methods also allow for the easy removal of the belt assembly 14, when that is desired.

Figure 4:
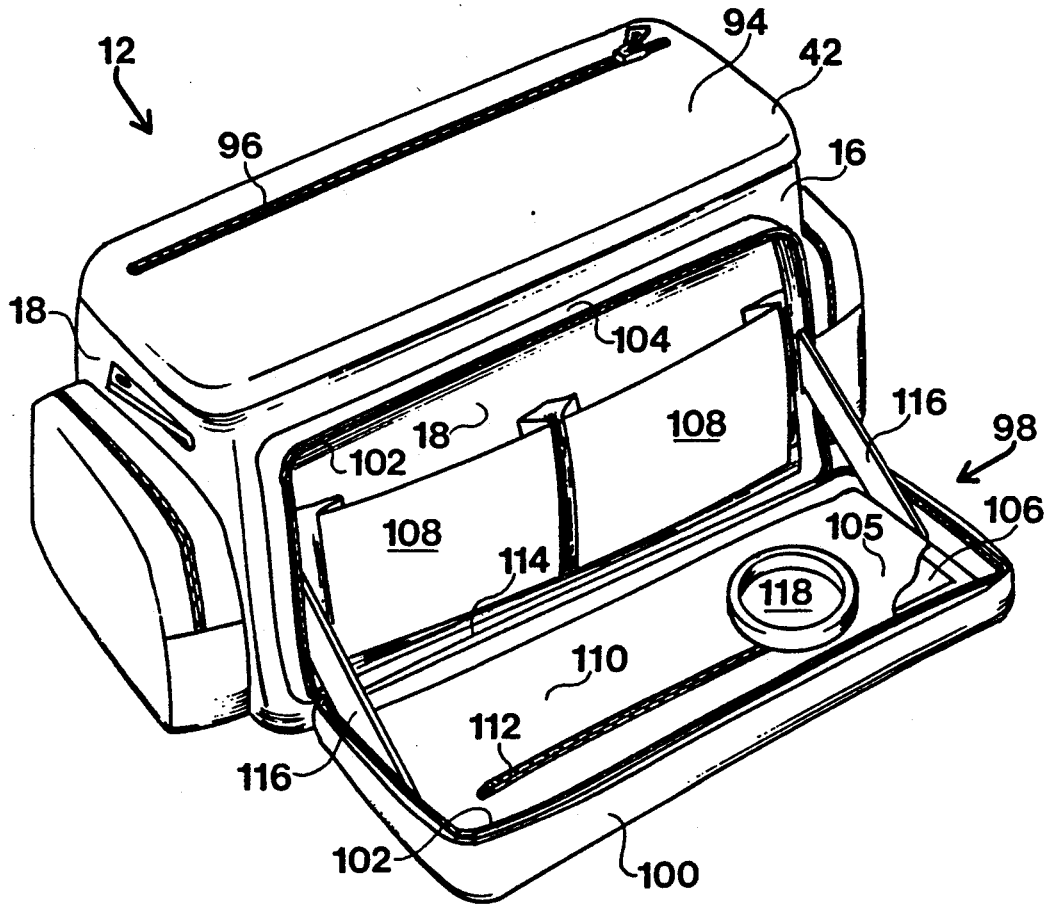
FIG. 4 is a front perspective view of the camera bag assembly, according to the present invention.

FIG. 4 is a front perspective view of the camera bag assembly 12 showing that side not visible in the view of FIG. 1, with the lid flap 42 closed. As can be seen in the view of FIG. 4, an outer lid pocket 94 is provided in the best presently known embodiment 10 of the invention, with an outer lid pocket zipper 96 for gaining access thereto.

A front pocket subassembly 98 is shown with a front pocket closure flap 100 open in the view of FIG. 4. The front pocket closure flap 100 is secured, when closed, by means of a front pocket zipper 102. The front pocket closure flap 100 and a front pocket edge portion 104 are constructed from the same material as is the outer shell 18 of the main enclosure 16 (FIG. 2). A flap liner 105 is sewn inside the front pocket closure flap 100 and, as can be seen in a cut away portion of FIG. 4, a semi-rigid pad 106 is sandwiched between the flap liner 105 and the front pocket closure flap 100. The semi-rigid pad 106 functions to protect any equipment which might be stored within the front pocket subassembly 98, and further to cause the front pocket closure flap 100 to be stiff enough to form a work surface when the front pocket closure flap 100 is opened, as will be discussed hereinafter.

Two pouches 108 are formed within the front pocket subassembly 98 by sewing a piece of light weight material, as shown in the drawing of FIG. 4, to the outer shell 18 of the main enclosure 16. Also within the front pocket subassembly 98 and attached to the front pocket closure flap 100 is a front inside pocket 110 having a front inside pocket zipper 112 as a means for selectively closing and gaining access thereto.

The front pocket closure flap 100 is hinged along a front pocket hinge line 114 in the same manner as has been described heretofore in relation to the connection of the lid flap 42 to the main enclosure 16. It should be noted that the zipper 102 differs from comparable prior art components in that the zipper 102 of the best presently known embodiment 10 of the present invention runs the length of three sides of the front pocket closure flap 100 such that the front pocket closure flap 100 is free to hinge at the flap hinge line 114, as shown. A pair of flexible flap limiting straps 116 are connected between the main enclosure 16 and the front pocket closure flap 100 such that, when open, the front pocket closure flap 100 is prevented from dropping past a position perpendicular to the main enclosure 16, as shown in the drawing of FIG. 4. Since, as has been discussed previously herein, the front pocket closure flap 100 is sufficiently rigid to act as a work surface, small items such as a lens cap 118, a lens cleaning tissue (not shown, or the like can be placed upon the pocket closure flap 100 during lens changes and similar operations.

Figure 5:
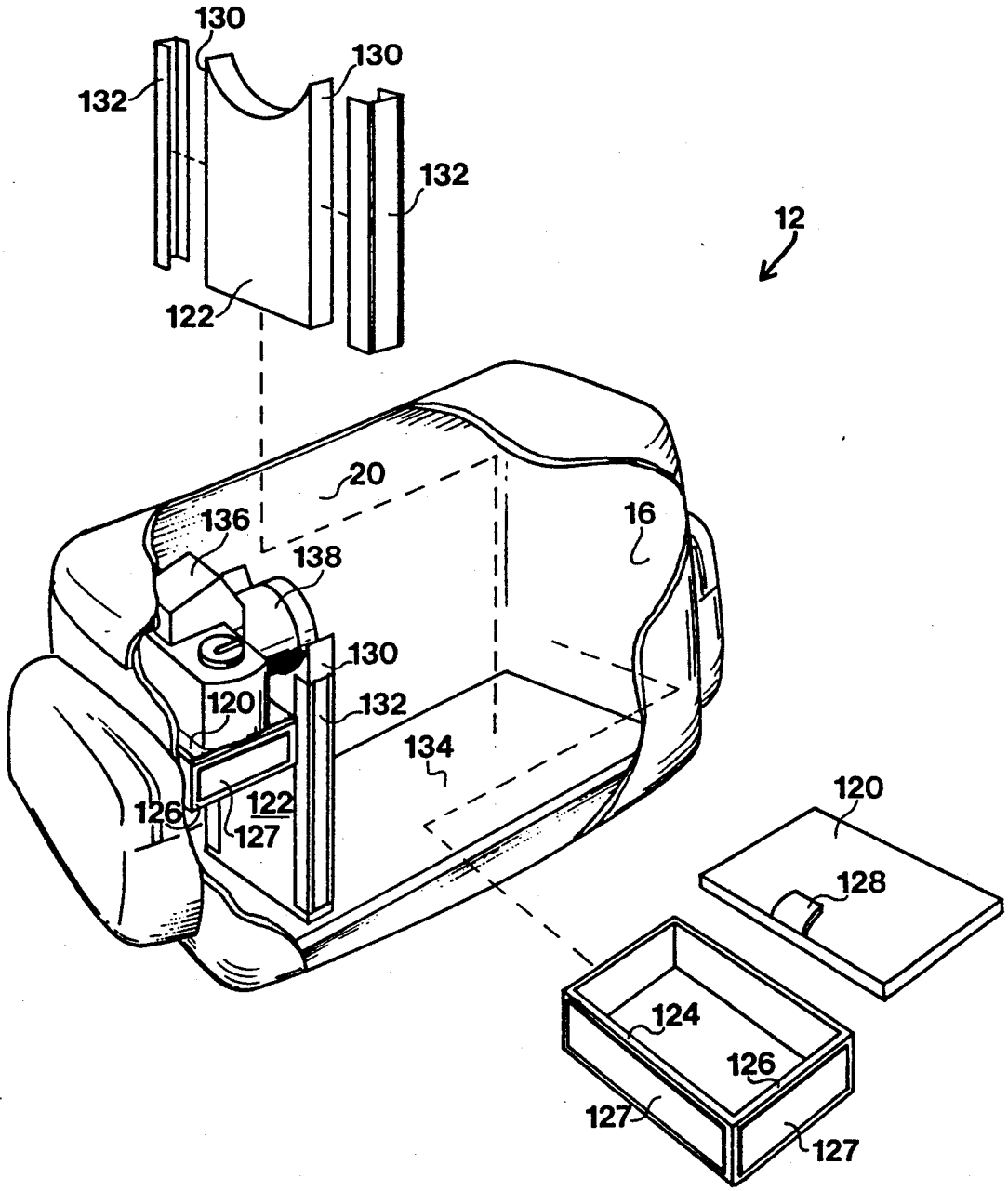
FIG. 5 is a partially exploded cut away perspective view of a camera bag assembly, according to the present invention, showing optional interior dividers.

FIG. 5 is a partially exploded cut away perspective view of the camera bag assembly 12. As can be seen in the view of FIG. 5, the best presently known embodiment 10 (FIG. 1) of the invention includes within the camera bag assembly 12 two horizontal dividers 120, two vertical dividers 122 and two horizontal divider support frames 124. The horizontal dividers 120, the vertical dividers 122 and the horizontal divider support frames 124 are optional components of the best presently known embodiment 10 of the invention which may be supplied, as required, according to the particular needs of the end user. The purpose of the horizontal dividers 120, the vertical dividers 122 and the horizontal divider support frames 124 is to compartmentalize the interior of the main enclosure 16 of the camera bag assembly 12 as might be required and, therefore, versatility is an important feature of these components. Accordingly, the horizontal dividers 120, the vertical dividers 122 and the horizontal divider support frames 124 are intended to be supplied in varying quantities to be placed as shown in the drawing of FIG. 5 by the end user, or otherwise according to the application. Furthermore, it is contemplated by the inventors that additional dividers (not shown), similar to the vertical dividers 122, might be supplied in various sizes and shapes to further compartmentalize the main enclosure 16. Furthermore, such additional dividers (not shown) might be supplied in different shapes for holding specific uniquely shaped pieces of camera equipment.

An outer support surface 126 of the horizontal divider support frames 124 has on a portion thereof a Velcro brand fastener hook strip 127. The Velcro brand fastener hook strip 127 attaches readily to the napped fabric of the liner 20. When in place, the horizontal dividers 120 rest upon the horizontal divider support frames 124. A grip tab 128 is provided on each of the horizontal divider support frames 124 which a user may grasp in order to lift the horizontal dividers 120 to gain access to any storage space thereunder.

The vertical dividers 122 have vertical edges 130 covered with a Velcro brand fastener hook edge covering 132 for attachment to the lining 20. The horizontal dividers 122 and the vertical dividers 124 of the best presently known embodiment 10 of the present invention are constructed of a composite foam and polyethylene plastic material. This material was chosen for the purpose because of its excellent strength to weight ratio. Alternatively, any semi-rigid material might be used for the purpose with, perhaps, somewhat less desirable results.

Also visible in the view of FIG. 5 is a rigid floor panel 134. The floor panel 134 is a common feature of soft sided camera bags. The floor panel 134 is a simple rectangular piece of rigid padded material of a size to just fit within the bottom of the main enclosure 16. The purposes of the floor panel 134 are to help the camera bag assembly 12 to hold a generally rectangular shape and also to protect equipment therein from the external objects upon which the camera transport system 10 might be placed. In the best presently known embodiment 10 of the invention, the floor panel 134 is held in place by means of Velcro brand fastener (not shown) thereunder.

As is shown above, in great part, the camera bag system 10 according to the present invention closely resemble prior art conventional camera bags in many respects. The substantial differences exist in the inclusion of the unique construction of the belt assembly 14, the unique means for attachment of the belt assembly to 14 to the camera bag assembly 12, the reinforcement plate 36 within the camera bag assembly 12 for providing the rigidity thereto necessary in the application, the unique lid flap 42 having a hinge line 44 opposed across the main enclosure 16 from the back wall 34, and the unique front pocket closure flap 100 which can function as a work surface. No significant changes of materials are envisioned nor are any special constructions required.

Various modifications may be made to the invention without altering its value or scope. For example, various individual aspects of the inventive combination might be deleted for the sake of economy. For instance, the unique front pocket closure flap 100 might be eliminated while retaining all of the other unique aspects of the invention.

Another conceivable change is to vary the non-inventive aspects of the invention so as to create a device quite dissimilar in appearance from the best presently known embodiment 10 of the present invention described herein, while retaining the unique aspects of the invention.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The inventive multifunctional camera bag with waist belt support is widely used in the field of photography. The predominant current usages are for outdoor field usages wherein a considerable amount of equipment must be carried, often over very rugged terrain.

The multifunctional camera bag of the present invention may be utilized in any application wherein conventional camera bags are used. The main areas of improvement are in the inventive belt, top flap, front pocket flap, means for attaching the belt to the camera bag, and means for maintaining the shape and form of the camera bag.

The components of the camera transport system 10, in combination, provide a means for carrying camera equipment which is both comfortable and convenient for the user, and further which provides superior protection for the equipment contained therein. As has been described herein, the camera bag assembly 12 can be detached from the belt assembly 14 and used with the shoulder strap 28, in much the same manner as a conventional camera bag. When used in that manner, the work surface provided by the front pocket closure flap 100 can be used to advantage. Also, the fact that the lid flap 42 opens away from the user, thus providing unobstructed access to the main enclosure 16 is also of some benefit in this mode, although, since it is not very difficult to remove the camera bag assembly 12 when it is being carried only by the shoulder strap 28, this feature is not as critical as it is when the belt assembly 14 is in use. In this mode also, the dividers 120 and 122 can be positioned, as for example as is shown in the view of FIG. 5, such that a camera 136 with a lens attached thereto 138 can be held securely in place.

When the belt assembly 14 is attached to the camera bag assembly 12, as described herein, the camera transport system 10 can be used to its fullest effect. The camera transport system 10 can be worn comfortably, even when heavily laden, given the anatomical contour of the belt assembly 14 and the foam pad 70. Since the camera bag assembly 12 is provided with sufficient rigidity to prevent deformation by means of the reinforcement plate 36 the belt assembly 14 may be worn rather loosely around the user's waist such that the camera transport system 10 may be moved around the user's waist to gain access to the camera 136 or other equipment therein. Without the reinforcement plate 36 and the other features as described herein which, in combination, provide the needed rigidity, the belt assembly 14 would have to be worn tighter to prevent the camera bag assembly 12 from sagging. Alternatively, the belt assembly 12 can be temporarily made tighter in order to provide lumbar support to the user during long hikes.

Since the multifunctional camera bags with waist belt support systems of the present invention may be readily constructed and are physically significantly similar to prior art conventional camera bags it is expected that they will be acceptable in the industry as substitutes for the conventional camera bags. For these and other reasons, it is expected that the utility and industrial applicability of the invention will be both significant in scope and long-lasting in duration.

We claim:

1. A camera transport system comprising:

a camera bag for containing camera equipment, said camera bag having a substantially rectangular bottom with four sides extending upward therefrom, one of said sides being a generally flat rear side intended to abut against the body of the user when the bag is carried normally;

carrying means whereby the camera bag is carried; and a substantially rectangular top closure flexibly attached about the one of said sides opposite said rear side such that said top closure hinges up and away from the user of the camera bag to open, when the camera bag is being carried by the carrying means with said generally flat rear side toward the user, wherein; the carrying means includes:

a belt attached to h camera bag such that said camera bag may be worn by the user with said top closure positioned so as to hinge up and away from said user;

said belt is attached to the camera bag by means of a plurality of camera bag attachment loops, a plurality of belt attachment loops, and an attachment strap, said camera bag attachment loops being permanently affixed to the camera bag and said belt attachment loops being permanently affixed to said belt, said attachment strap being interlaced through said camera bag attachment loops and through said belt attachment loops such that said belt is effectively removably attached to the camera bag and further wherein said belt is attached to said camera bag by a Velcro brand type fastener system comprising a first panel and a second panel, said first panel being firmly attached to said belt and said second panel being firmly attached to said camera bag such that, when said attachment strap is interlaced through said camera bag attachment strap is interlaced through said belt attachment loops, said first panel mates with said second panel thus providing additional disconnectable support for holding said camera bag fixed n relation to said belt.

2. The camera transport system of claim 1, and further including:

a plurality of dividers for compartmentalizing the interior of the camera bag.

3. The camera transport system of claim 2, wherein said dividers are movable within the interior of the camera bag such that said interior may be compartmentalize as desired by the user of the camera bag.

4. The camera transport system of claim 1, and further including:

an exterior packet attached to the camera bag on the exterior of the camera bag such that said exterior pocket is on the one of said sides of the camera bag which is opposite said rear side, said exterior pocket having a generally rectangular closure flap flexibly attached thereto at the bottom of said closure flap such that said closure flap provides a work surface when said closure flap is open;

closure means or further attaching said closure flap to said exterior pocket such that said closure flap may be optionally held in a closed position by said closure means; and positioning means for preventing the force of gravity from moving said closure flap past a position perpendicular other camera bag, such that said closure flap is usable as a work surface when the camera bag is being carried by the carrying means.

5. The camera transport system of claim 1, and further including:

a plurality of exterior pockets attached to said belt such that said exterior pockets may be used for storage when said belt is being work by the user.

6. The camera transport system of claim 1 wherein:

said belt is removably attached to the camera bag such that the camera bag may be carried by means of a shoulder strap when said belt is removed.

7. The camera transport system of claim 1, and further including:

a plurality of attachment buckle portions attached to said camera belt for mating with a like plurality of complementary buckle portion attached to the camera bag, thus providing additional disconnectable support for holding the camera bag fixed in relation to said belt.

8. The camera transport system of claim 1, and further including:

a reinforcement plate integral with one of said sides of the camera bag such that the camera bag resist deformation under the weight of the contents thereof.

9. A camera equipment carrying device comprising:

a camera bag having a reinforce upright wall which is substantially more rigid than a remainder of sides of the camera bag, and a waist belt attached to said reinforce upright wall such that, when the camera bag is being carried by means of the waist belt, said reinforced upright wall remains reflectively congruent with a center portion of the waist belt whereon the camera bag is attached, the waist belt being substantially wider at said center portion than at a pair of belt end portions, wherein the waist belt is removable attached to said reinforced upright wall by means including:

a plurality of attachment loops, at least a portion of the attachment loops being permanently affixed to the camera bag and at least a portion of the attachment loops being permanently afixed to said center portion of the waist belt; an attachment strap interlaced through the attachment loops of the camera bag and the center portion of the waist belt; and a hook and loop fastener system having a first mating portion and a second mating portion, the first mating portion being affixed to the waist belt and the second mating portion being affixed to the camera bag such that, when the camera bag is attached to the waist belt by the attachment strap, the first mating portion removably attaches to the second mating portion at the same time for providing additional support of the camera bag.

10. The camera equipment carrying device of claim 9, wherein:

said wider center portion of the waist belt is formed such that it is tapered toward said belt end portions in such a manner that the waist belt is anatomically contoured.

* * * * *